United States Patent [19]

Gouvianakis et al.

[11] Patent Number: 4,944,013

[45] Date of Patent: Jul. 24, 1990

[54] MULTI-PULSE SPEECH CODER

[75] Inventors: Nikolaos Gouvianakis; Costas Xydeas, both of Loughborough, England

[73] Assignee: British Telecommunications public limited company, United Kingdom

[21] Appl. No.: 846,854

[22] Filed: Apr. 1, 1986

[30] Foreign Application Priority Data

Apr. 3, 1985 [GB] United Kingdom ..... 8508669
Jun. 19, 1985 [GB] United Kingdom ..... 8515501

[51] Int. Cl.[5] ..... G10L 7/02
[52] U.S. Cl. ..... 381/38
[58] Field of Search ..... 381/36–40, 381/41, 49–50, 29–32; 364/513.5

[56] References Cited

U.S. PATENT DOCUMENTS

| | | | |
|---|---|---|---|
| 4,472,832 | 9/1984 | Atal et al. | 381/40 |
| 4,669,120 | 5/1987 | Ono | 381/40 |
| 4,701,954 | 10/1987 | Atal | 381/49 |
| 4,716,592 | 12/1987 | Ozawa et al. | 381/40 |
| 4,720,865 | 1/1988 | Taguchi | 381/49 |
| 4,724,535 | 2/1988 | Ono | 381/31 |

FOREIGN PATENT DOCUMENTS

| | | |
|---|---|---|
| 0137532 | 8/1984 | European Pat. Off. . |
| 2137054A | 3/1983 | United Kingdom . |

OTHER PUBLICATIONS

Atal et al., "A New Model of LPC Excitation for Producing Natural Sounding Speech at Low Bit Rates", ICASSP 82, May 3–5, 1982, pp. 614–617.

Berouti et al., "Efficient Computation and Encoding of the Multipulse Excitation for LPC", ICASSP 94, Mar. 19–21, 1984, pp. 10.1.1–10.1.4.

Kroon et al., "Experimental Evaulation of Different Approaches to the Multi-Pulse Coder", ICASSP 84, Mar. 19–21, 1984, pp. 10.4.1–10.4.4.

"Architecture Design of a High-Quality Speech Synthesizer Based on the Multipulse LPC Technique" IEEE Journal on Selected Areas in Communications vol. SAC-3 (1985) Mar. No. 2, New York, U.S.A., by Sharma, pp. 377–383.

"An Efficient Method for Creating Multi-Pulse Excitation Sequences"-Links for the Future Science, Systems & Services for Comm. IEEE/Elsevier Science Publlishers B V (North Holland) 1984-by Jain et al, pp. 1496–1499.

"Multi-Pulse Excited Speech Coder Based on Maximum Crosscorrelation Search Algorithm"-IEEE Global Telecommunications Conference San Diego, Calif. Nov. 28–Dec. 1, 1983, vol. 2 or 3-pp. 794–798, by Araseki, Ozawa, Ono and Ochiai.

"Low Bit Rate Speech Enhancement Using a New Method of Multiple Impulse Excitation"-ICASSP 84 Proceedings Mar. 19–21, San Diego, Calif. IEEE International Conference on Acoustics, Speech and Signal Processing pp. -1.5.1.–1.5.4 and 10.2.1–10.2.4.

*Primary Examiner*—Gary V. Harkcom
*Assistant Examiner*—John A. Merecki
*Attorney, Agent, or Firm*—Nixon & Vanderhye

[57] ABSTRACT

Speech is coded such that it can be generated by a pulse excitation sequence filtered by an LPC (linear preductive coding) filter. The sequence contains, in each of successive frame periods, pulses whose positions and amplitudes may be varied. These variables are selected at the coding end to reduce the error between the input and regenerated speech signals. The selection process involves derivation of an initial estimate followed by an iterative adjustment process in which pulses having a low energy contribution are tested in alternative positions and transferred to them if a reduced error results.

18 Claims, 9 Drawing Sheets

MULTI-PULSE SPEECH CODER

CROSS REFERENCES TO RELATED APPLICATIONS

This application is related to copending commonly assigned, later filed, U.S. patent application Ser. No. 187,533 filed May 3, 1988, now U.S. Pat. No. 4,864,621 and UK patent application 8/00120.

BACKGROUND OF THE INVENTION

1. Field of the Invention

This invention is concerned with speech coding, and more particularly to systems in which a speech signal can be generated by feeding the output of an excitation source through a synthesis filter. The coding problem then becomes one of generating, from input speech, the necessary excitation and filter parameters. LPC (linear predictive coding) parameters for the filter can be derived using well-established techniques, and the present invention is concerned with the excitation source.

2. Description of Related Art

Systems in which a voiced/unvoiced decision on the input speech is made to switch between a noise source and a repetitive pulse source tend to give the speech output an unnatural quality, and it has been proposed to employ a single "multipulse" excitation source in which a sequence of pulses is generated, no prior assumptions being made as to the nature of the sequence. It is found that, with this method, only a few pulses (say 6 in a 10 ms frame) are sufficient for obtaining reasonable results. See B. S. Atal and J. R. Remde: "A New Model of LPC Excitation for producing Natural-sounding Speech at Low Bit Rates", Proc. IEEE ICASSP, Paris, pp.614, 1982.

Coding methods of this type offer considerable potential for low bit rate transmission—e.g. 9.6 to 4.8 Kbit/s.

The coder proposed by Atal and Remde operates in a "trial and error feedback loop" mode in an attempt to define an optimum excitation sequence which, when used as an input to an LPC synthesis filter, minimizes a weighted error function over a frame of speech. However, the unsolved problem of selecting an optimum excitation sequence is at present the main reason for the enormous complexity of the coder which limits its real time operation.

The excitation signal in multipulse LPC is approximated by a sequence of pulses located at non-uniformly spaced time intervals. It is the task of the analysis by synthesis process to define the optimum locations and amplitudes of the excitation pulses.

In operation, the input speech signal is divided into frames of samples, and a conventional analysis is performed to define the filter coefficients for each frame. It is then necessary to derive a suitable multipulse excitation sequence for each frame. The algorithm proposed by Atal and Remde forms a multipulse sequence which, when used to excite the LPC synthesis filter minimizes (that is, within the constraints imposed by the algorithm) a mean-squared weighted error derived from the difference between the synthesized and original speech. This is illustrated schematically in FIG. 1. The positions and amplitudes of the excitation pulses are encoded and transmitted together with the digitized values of the LPC filter coefficients. At the receiver, given the decoded values of the multipulse excitation and the prediction coefficients, the speech signal is recovered at the output of the LPC synthesis filter.

In FIG. 1 it is assumed that a frame consists of n speech samples, the input speech samples being $s_o \ldots s_{n-1}$ and the synthesized samples $s_o' \ldots s_{n-1}'$, which can be regarded as vectors $\bar{s}, \bar{s}'$. The excitation consists of pulses of amplitude $a_m$ which are, it is assumed, permitted to occur at any of the n possible time instants within the frame, but there are only a limited number of them (say k). Thus the excitation can be expressed as an n-dimensional vector $\bar{a}$ with components $a_o \ldots a_{n-1}$, but only k of them are non-zero. The objective is to find the 2k unknowns (k amplitudes, k pulse positions) which minimize the error:

$$\bar{e}^2 = (\bar{s} - \bar{s}')^2 \quad (1)$$

—ignoring the perceptual weighting, which serves simply to filter the error signal such that, in the final result, the residual error is concentrated in those parts of the speech band where it is least obtrusive.

The amount of computation required to do this is enormous and the procedure proposed by Atal and Remde was as follows:

(1) Find the amplitude and position of one pulse, alone, to give a minimum error.

(2) Find the amplitude and position of a second pulse which, in combination with this first pulse, gives a minimum error; the positions and amplitudes of the pulse(s) previously found are fixed during this stage.

(3) Repeat for further pulses.

This procedure could be further refined by finally reoptimizing all the pulse amplitudes; or the amplitudes may be reoptimized prior to derivation of each new pulse.

SUMMARY OF THE INVENTION

It will be apparent that in these procedures the results are not optimum, inter alia because the positions of all but the kth pulse are derived without regard to the positions or values of the later pulses: the contribution of each excitation pulse to the energy of synthesized signal is influenced by the choice of the other pulses. In vector terms, this can be explained by noting that the contribution of $a_m$ is $a_m\bar{f}_m$ where $\bar{f}_m$ is the LPC filter's impulse response vector displaced by m, and that the set of vectors $\bar{f}_m$ are not, in general, orthogonal. (where $m=0 \ldots n-1$).

The present invention offers a method of deriving pulse parameters which, while still not optimum, is believed to represent an improvement.

According to one aspect of the present invention we provide a method of speech coding comprising:

receiving speech samples;

processing the speech samples to derive parameters representing a synthesis filter response;

deriving, from the parameters and the speech samples, pulse position and amplitude information defining an excitation consisting, within each of successive time frames corresponding to a plurality of speech samples, of a pulse sequence containing a smaller plurality of pulses, the pulse amplitudes and positions being controlled so as to reduce an error signal obtained by comparing the speech samples with the response of the synthesis filter to the excitation;

wherein the pulse position and amplitude information is derived by:

(1) deriving an initial estimate of the positions and amplitudes of the pulses, and (2) carrying out an iterative adjustment process in which individual pulses are selected and their positions and amplitudes reassessed.

BRIEF DESCRIPTION OF THE DRAWINGS

Some embodiments of the invention will now be described, by way of example, with reference to the accompanying drawings, in which.

DESCRIPTION OF THE PREFERRED EMBODIMENT(S)

Figure 2:
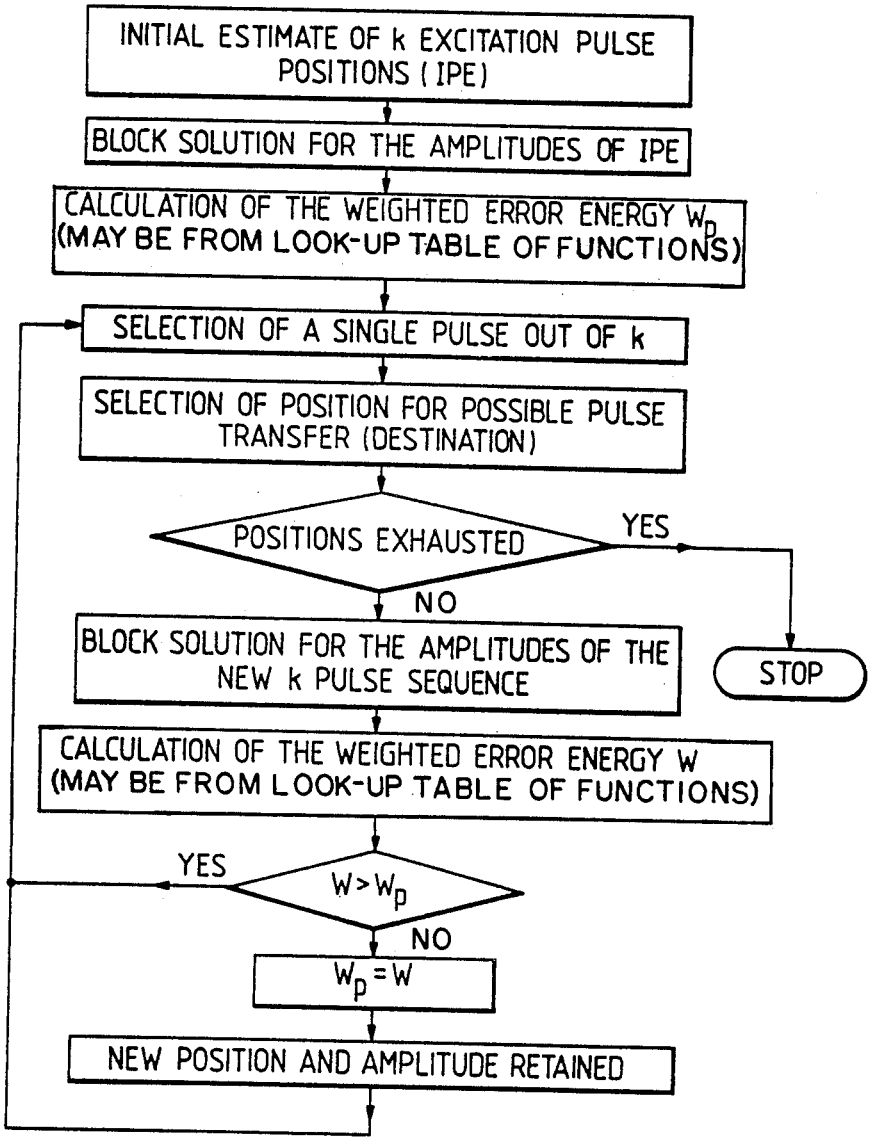
FIG. 2 is a brief flowchart of the algorithm used in the exemplary embodiment of the present invention.

It has already been explained that the objective is to find, for each time frame, the parameters of the k non-zero pulses of the desired excitation $\bar{a}$. For convenience the excitation is redefined in terms of a k-dimensional vector $\bar{c}$ containing the amplitude values $c_1$ to $c_k$, and pulse positions p (i=1 . . . k) which indicate where these pulses occur in the n-dimensional vector. The flow chart of the algorithm used in an exemplary embodiment of the invention is shown in FIG. 2. An initial position estimate of the pulse positions $p_i$, i=1,2, . . . k, is first determined. A block solution for the optimum amplitudes then defines the initial k-pulse excitation sequence and a weighted error energy $W_p$ is obtained from the difference between the synthesized and the input speech.

The selection of only one pulse follows whose position $p_m$ might be altered within the analysis frame. The algorithm decides on a new possible location for this pulse and the block solution is used to determine the optimum amplitudes of this new k-pulse sequence which shares the same k−1 pulse locations with the previous excitation sequence. The new location is retained only if the corresponding weighted error energy W is smaller than $W_p$ obtained from the previous excitation signal.

The search process continues by selecting again one pulse out of the k available pulses and altering its position, while the above procedure is repeated. The final k-pulse sequence is established when all the available destination positions within the analysis frame have been considered for the possibility of a single pulse transfer.

The search algorithm which defines (i) the location of a pulse suitable for transfer and (ii) its destination, is of importance in the convergence of the method towards a minimum weighted error. Different search algorithms for pulse selection and transfer will be considered below.

Firstly, we consider the initial estimate step. In principle, any of a number of procedures could be used—including the multistage sequential search procedures discussed above proposed by other workers. However, a simplified procedure is preferred, on the basis that the reduction in accuracy can be more than compensated for by the pulse transfer stage, and that the overall computational requirement can be kept much the same.

One possibility is to find the maxima of the cross correlation between the input speech and the LPC filter's impulse response. However, as voiced speech results in a smooth crosscorrelation which offers a limited number of local maxima, a multistage sequential search algorithm is preferred.

We recall that $$s' = \sum_{m=0}^{n-1} a_m f_m + m \tag{2}$$

Where $\bar{m}$ is the filter's memory from previously synthesized frames.

Since only k values of the excitation are non-zero Eq. 2 can be written as:

$$s' = \sum_{i=1}^{k} a_{pi} f_{pi} + m \tag{3}$$

where $p_i$ is the location index. Consider that the n normalized vectors $$b_m = \frac{f_m}{\|f_m\|}$$

define a basis of unit vectors in an n-dimensional space. Eq 3 shows that the synthesized speech vector can be thought of as the sum of k n-dimensional vectors $a_{pi}$ $||\bar{f}_{pi}||$ $\bar{b}_{pi}$ which are obtained by analysing $\bar{s}'$ in a k dimensional subspace defined by the $\bar{b}_{Pi}$, i=1,2, . . . k unit vectors.

At each stage of the search the location of an o additional excitation pulse is determined by first obtaining all the orthogonal projections $\bar{q}_i$,i=0,1, . . . n−1 of an input vector $\bar{s}_d$ onto the n axes of the analysis space and then selecting the projection $\bar{q}_{max}$ with the maximum magnitude. These projections correspond to the cross-correlation between $\bar{s}_d$ and the basis vectors $\bar{b}_i$, i=0,1, . . . n−1. The vector $\bar{s}_d$ is updated at each stage of the process by subtracting $\bar{q}_{max}$ from it. Note that the initial value $\bar{s}_d$ is the input speech vector $\bar{s}$ minus the filter memory $\bar{m}$.

The algorithm can be implemented without the need to find $\bar{s}_d$ prior to the calculation of all the cross correlation values $||\bar{q}_i||$, at each stage of the process. Instead, $\bar{q}_i$, i=0,1 . . . n−1, are defined directly using the linearity property of projection. Thus at the jth stage of the process $\bar{q}_i(j)$ is formed by subtracting the projection of $\bar{q}_{max}(j-1)$ onto the n axes, from $\bar{q}_i(j-1)$ i.e.

$$q_i(j) = q_i(j-1) - \text{Proj}\,[q_{max}(j-1)]_i \qquad i = 0,1 \ldots n-1 \tag{4}$$

However, as $\bar{q}_{max} = ||\bar{q}_{max}||\ \bar{b}_l$, where $\bar{b}_l$ is the unit basis vector of the axis where $\bar{q}_{max}$ lies, the orthogonal projections of $\bar{q}_{max}$ onto the n axes are:

$$\text{Proj}\,[q_{max}]_i = \|q_{max}\|\,(b_l \cdot b_i)\,b_i \qquad i = 0,1, \ldots n-1 \tag{5}$$

Note that (i) the above n dot products $B_{li}=\bar{b}_l \cdot \bar{b}_i$, i=0,1, . . . n−1, are normalized autocovariance estimates of the LPC filter's impulse response, and (ii) k.n autocovariance estimates are needed for each analysis frame.

Thus during the first stage of the method, n cross-correlation values $||\bar{q}_i||$, i=0,1, . . . n−1 are calculated between the input speech vector $\bar{s}$ and $\bar{b}_i$. The maximum value $||\bar{q}_{max}||$ is then detected to define the location and amplitude of the first excitation pulse. In the next stage the n values $||\bar{q}_{max}||\ B_{li}$, i=0,1 . . . n−1 are subtracted from the previously found cross correlation values and a new maximum value is determined which provides the location and amplitude of the second pulse. This continues until the locations of the k excitation pulses are found.

The complexity of the algorithm can be considerably reduced by approximating the normalized autocovariance estimates of the LPC filter's impulse response $B_{li}$ with normalized autocorrelation estimates $R_{li}$ whose value depends only on the 1−i difference, viz. $R_{l,i}=B_{0,|l-i|}$. In this case only n autocorrelation estimates are calculated for each analysis frame compared to the k.n previously required. The performance of this simplified algorithm, in accurately locating the excitation pulse positions, is reduced when compared to that of the original method. The above approximation however makes the simplified method very satisfactory in providing the initial position estimates.

The initial position estimate may be modified to take account of a perceptual weighting—in which case the filter coefficients $\bar{f}_m$ (and hence the normalised vectors $\bar{b}$) would be replaced by those ccrresponding to the combined filter response; and the signal for analysis is also modified.

The pulse positions having been determined, the amplitudes may then be derived. Once a set of k pulse positions is given a "block" approach is used to define the pulse amplitudes. The method is designed to minimize the energy of a weighted error signal formed from the difference between the input $\bar{s}$ and the synthesized $\bar{s}'$ speech vectors. $\bar{s}'$ is obtained at the output of the LPC synthesis filter $F(z)=1/[1-P(z)]$ as:

$$\bar{s}'=R\bar{a}+\bar{m} \tag{6}$$

where R is the n×n lower triangular convolution matrix $$R=\begin{bmatrix} r_o & 0 & 0 & \dots & 0 \\ r_1 & r_o & 0 & & \\ r_{n-1} & r_{n-2} & & \dots & r_o \end{bmatrix} \tag{7}$$

$r_k$ is the kth value of the F(z) filter's impulse response, $\bar{a}$ is the vector containing the n values of the excitation and $\bar{m}$ is the filter's memory from the previously synthesized frames.

Since the excitation vector $\bar{a}$ consists of k pulses and n−k zeros, Eq 6 can be written as:

$$\bar{s}=S\bar{c}+\bar{m} \tag{8}$$

where S is now a n×k convolution matrix formed from the columns of R which correspond to the k pulse locations, and $\bar{c}$ contains the k unknown pulse amplitudes. The error vector $$\bar{e}=\bar{s}-\bar{m}-S\bar{c}=\bar{x}-S\bar{c} \tag{9}$$

Where $\bar{x}=\bar{s}-\bar{m}$ has an energy $\bar{e}^T\bar{e}$ which can be minimized using Least Squares and the optimum vector $\bar{c}$ is given by:

$$\bar{c}=(S^TS)^{-1}S^T\bar{x} \tag{10}$$

As previously mentioned the error however has a flat spectral characteristic and is not a good measure of the perceptual difference between the original and the synthesized speech signals. In general due to the relatively high concentration of speech energy in formant regions, larger errors can be tolerated in the formant regions than in the regions between formants. The shape of the error spectrum is therefore modified using a linear shaping filter V(z).

Whence the weighted error $\bar{u}$ is given by:

$$\bar{u}=V\bar{x}-VS\bar{h}=\bar{y}-D\bar{h} \tag{11}$$

where $\bar{y}$ and D correspond to the "transformed" by V signal $\bar{x}$ and convolution matrix S respectively. An error is therefore defined in terms of both the shaping filter V and the excitation sequence $\bar{h}$ required to produce the perceptually shaped error $\bar{u}$. The actual error is still of course $\bar{x}-S\bar{h}$ and is designated $\bar{e}'$, whence $$\bar{e}'=V^{-1}\bar{u} \tag{12}$$

Furthermore $\bar{u}^T\bar{u}$ is minimized when $$\bar{h}=(D^TD)^{-1}D^T\bar{y} \tag{13}$$

in which case the spectrum of $\bar{u}$ is flat and its energy is $$\bar{u}^T\bar{u}=\bar{y}^T\bar{y}-\bar{h}^TD^T\bar{y} \tag{14}$$

Figure 1:
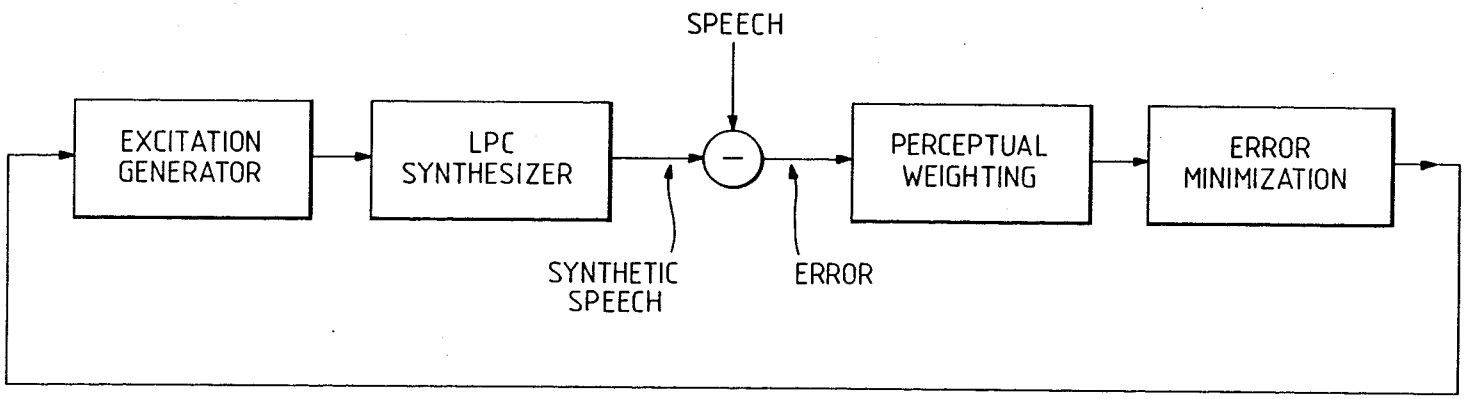
Fig. 1. (PRIOR ART)
FIG. 1 is a block diagram illustrating the coding process.

Thus the "perceptually optimum" excitation sequence can be obtained by minimizing the energy of the error vector $\bar{u}$ of Eq. 13, where both the input signal $\bar{x}$ and the synthesis filter F(z) have been modified according to the noise shaping filter V(z). Since the minimization is performed in a modified n-dimensional space, the actual error energy $\bar{e}'^T\bar{e}'$ (see FIG. 1) is expected to be larger than the error energy $\bar{e}^T\bar{e}$ found using $\bar{c}$ from Eq. 10.

The filter V(z) is set to:

$$V(z)=[1-P(z)]/[1-P(z/g)] \tag{15}$$

Where g controls the degree of shaping applied on the flat spectrum of $\bar{u}$ (Eq. 12). When g=1 there is no shaping while when g=0 then $V(z)=[1-P(z)]$ and full spectral shaping is applied. The choice of g is not too critical in the performance of the system and a typical value of 0.9 is used.

Notice from Eq. 11 that V deemphasizes the formant regions of the input signal $\bar{x}$ and that the modified filter T(z) (whose convolution matrix is V R=T) has a transfer function 1/[1−P(z/g)]. Also an interesting case arises for g=0 where $\bar{y}=V\bar{x}$ becomes the LPC residual and $D^TD$ is a unit matrix. The optimum k pulse excitation sequence consists in this case (see Eq. 13), of the k most significant in amplitude samples of the LPC residual.

The pulse amplitudes $\bar{h}$ can be efficiently calculated using Eq. 13 by forming the n-valued cross-correlation $C_{Ty}=T^T\bar{y}$ between the transformed input signal $\bar{y}$ and the impulse response of T(z) only once per analysis frame. Note here that T is the full nxn matrix as opposed to the nxk matrix D. $C_{Ty}$ can be conveniently obtained at the output of the modified synthesis filter whose input is the time reversed signal $\bar{y}$. Thus instead of calculating o the k cross-correlation values DTy, every time Eq. 13 is solved for a particular set of pulse positions, the algorithm selects from $C^T\bar{y}$ the values which correspond to the position of the excitation pulses and in this way the computational complexity is reduced.

Another simplification results from the fact that only one pulse position, out of k, is changed when a different set of positions is tried. As a result the symmetric matrix $D^TD$ found in Eq. 13 only changes in one row and one column every time the configuration of the pulses is altered. Thus given the initial estimate, the amplitudes h for each of the following multipulse configurations can be efficiently calculated with approximately $k^2$ multiplications compared to the $k^3$ multiplications otherwise required.

Finally an approximation is introduced to further reduce the computational burden of forming the $D^TD$ matrix for each set of pulse positions.

$D^TD$ is formed from estimates of the autocovariance o of the T(z) filter's impulse response. These estimates are also elements of a larger $n \times n$ $T^TT$ matrix. The method is considerably simplified by making $T^TT$ Toeplitz. In this case there are only n different elements in $T^TT$ which can be used to define $D^TD$ for any configuration of excitation pulses. These elements need only to be determined once per analysis frame by feeding through T(z) its reversed in time impulse response. In practice, though, it is more efficient to carry out updating (as opposed to recalculation) processes on the inverse matrix $(D^TD)^{-1}$.

Consider now the pulse transfer stage. The convergence of the proposed scheme towards a minimum weighted error depends on the pulse selection and transfer procedures employed to define various k-pulse excitation sequences. Once the initial excitation estimate has been determined, a pulse is selected for possible transfer to another position within the analysis frame (see FIG. 2).

The criteria for this selection—and for selecting its destination—may vary. In the examples which follow, the destination positions are, for convenience, examined sequentially starting at one end of the frame. Clearly, other sequences would be possible.

The pulse selection procedure employs the term $\bar{h}^TD^T\bar{y}$ of Eq. 14, which represents the energy of the synthesised signal and is the sum of k energy terms. Each of these terms, which is the product of an excitation pulse amplitude with the corresponding element of the cross correlation vector $C_{Ty}$, represents the energy contribution of the pulse towards the total energy of the synthesized signal. The pulse with the smallest energy contribution is considered as the most likely one to be located in the wrong position and it is therefore selected for possible transfer to another position.

The procedure adopted is as follows:

a. Choose the "lowest energy pulse" using the above criterion.

b. define a new excitation vector in which the pulse positions are as before except that the chosen pulse is deleted and replaced by one at position w (w is initially 1).

c. recalculate the amplitudes for the pulses, as described above.

d. compare the new weighted error with the reference error

—if the new error is not lower, increase w by one and return to step b to try the next position. Repetition of step a is not necessary at this point since the "lowest energy" pulse is unchanged.

—if the error is lower, retain the new position, make the new error the reference, increment w, and return to step a to identify which pulse is now the "lowest energy" pulse.

Figure 3B:
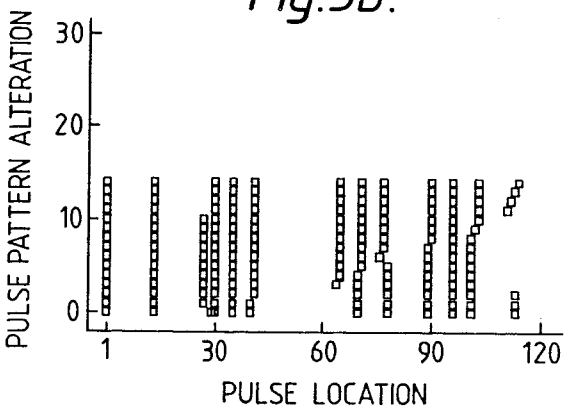
FIGS. 3*a* and 3*b* illustrate the operation of the pulse transfer iteration.
Figure 3A:
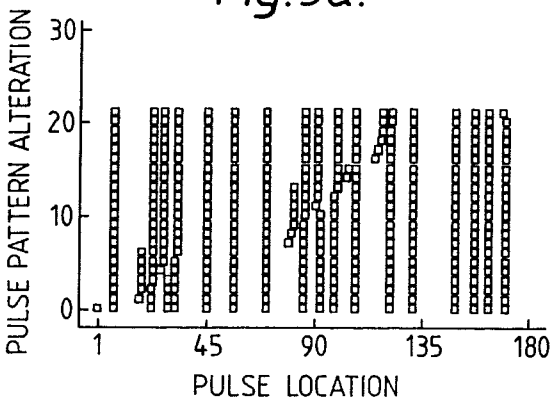

This process continues until w reaches n—i.e. all possible "destination" positions have been tried. During the process, of course, the previous position of the pulse being tested, and positions already containing a pulse are not tested—i.e. w is 'skipped' over those positions. As an extension of this, different selection criteria may be employed in dependence on whether the "destination" in question is a pulse position adjacent an existing pulse., i.e. each pulse at position j defines a region from $j-\lambda$ to $j+\lambda$ and when w lies within a region a different criterion is used. For example:

A. outside regions—"lowest energy" pulse selected
within regions—no pulse selected thus when w reaches $j-\lambda$ it is automatically incremented to $j+\lambda+1$ B. outside regions—"lowest energy" pulse selected
within region—the pulse defining the region is selected C. outside regions—no pulse selected
within region—the pulse defining the region is selected FIGS. 3*a* and 3*b* illustrate the successive pulse position patterns examined when the algorithm employs the B scheme. In FIG. 3*a* an analysis frame of n=180 samples is used while n=120 in FIG. 3*b*. In both cases the number of pulses k, is equal to n/10.

In practice, the coding method might be implemented using a suitably programmed digital computer. More preferably, however, a digital signal processing (DSP) chip—which is essentially a dedicated microprocessor employing a fast hardware multiplier—might be employed.

The coding method discussed in detail above might conveniently be summarised as follows: For each frame I. Evaluate the LPC filter coefficients, using the maximum entropy method.

II (a). find the impulse response of the weighted filter. (this gives us the convolution matrix T=VR)

(b). find the autocorrelation of the weighted filter's impulse response (c). subtract the memory contribution and weight the results; i.e. find $\bar{y}=V\bar{x}=V(\bar{s}-\bar{m})$ (d). find the cross-correlation of the weighted signal and the weighted impulse response III. make the initial estimate, by—starting with j=1 and $q_i(1)$ being the cross-correlation values already found (a). find the largest of $||\bar{q}_i(j)||$ which is $||q_{max}(j)||=||\bar{q}_1(j)||$, noting the value of l (b). find the n values $||\bar{q}_{max}(j)||\ R_{li}$ (c). subtract these from $||\bar{q}_i(j)||$ to give $||\bar{q}_i(j+1)||$ (d). repeat steps (a) to (d) until k values of 1—which are the derived pulse positions—have been found.

IV. Find the amplitudes by (a). finding $C_{Dy}=D^T\bar{y}$ (obtained from the k pulse positions simply by selecting the relevant columns of the cross-correlation from II(d)above)

(b). find the amplitudes h using the steps defined by equation (13); $(D^TD)^{-1}$ is initially calculated and then updated (c). finding the k energy $\bar{h}\ C_{Dy}$ V. Carry out the pulse position adjustment by—starting with w=1:

(a). checking whether w is within $\neq\lambda$ of an existing pulse, and if not (assuming option A) omitting the pulse having the lowest energy term and substituting a pulse at position w (b). repeat steps IV to find the new amplitudes and error (c). advance w to the next available position—if none is available, proceed to step (f)

(d). if the error is not lower than the reference error, return to step Va (e). if the error is lower, make the new error the reference error, retain the new amplitude and position and energy terms and return to step (a)

(f). calculate the memory contribution for the next frame

VI. Encode the following information for transmission:

(a). the filter coefficients (b). the k pulse positions (c). the k pulse amplitudes.

VII. Upon reception of this information, the decoder (a). sets the LPC filter coefficients (b). generates an excitation pulse sequence having k pulses whose positions and amplitudes are as defined by the transmitted data.

A typical set of parameters for a coder are as follows

Bandwidth 3.4 KHz

Sampling rate 8000 per second

LPC order 12

LPC update period 22.5 ms

Frame size (n) 120 samples

Spectral shaping factor (g) 0.9

No of pulses per frame (k) 12 (800 pulses/sec)

Figure 4:
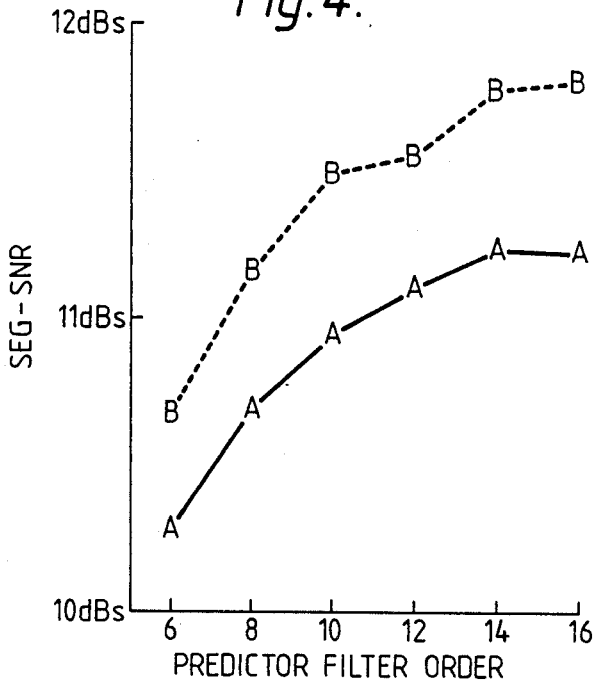
FIGS. 4 to 7 are graphs illustrating the signal-to-noise ratios that may be obtained.

Results obtained by computer simulation using sentences of both male and female speech, are illustrated in FIGS. 4 to 7. Except where otherwise indicated, the parameters are as stated above. In FIG. 4, segmented signal-to-noise ratio, averaged over 3 sec of speech, for pulse transfer options A and B, is shown for LPC prediction order varying from 6 to 16.

Figure 5:
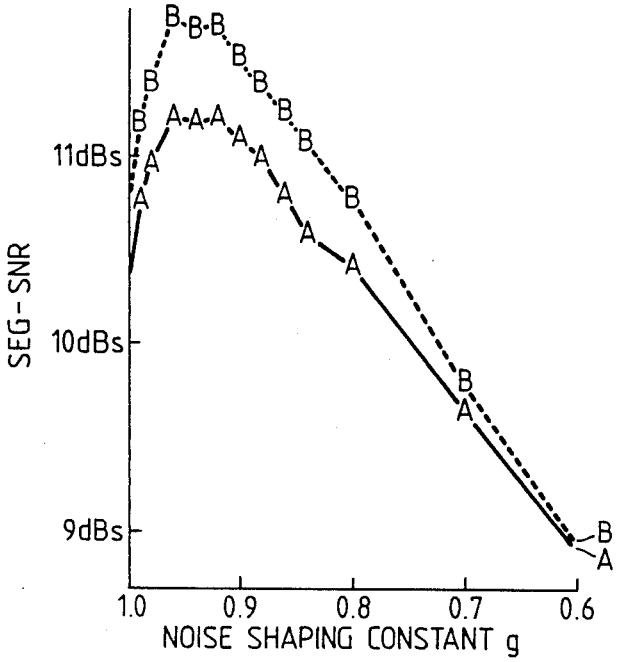
Figure 7:
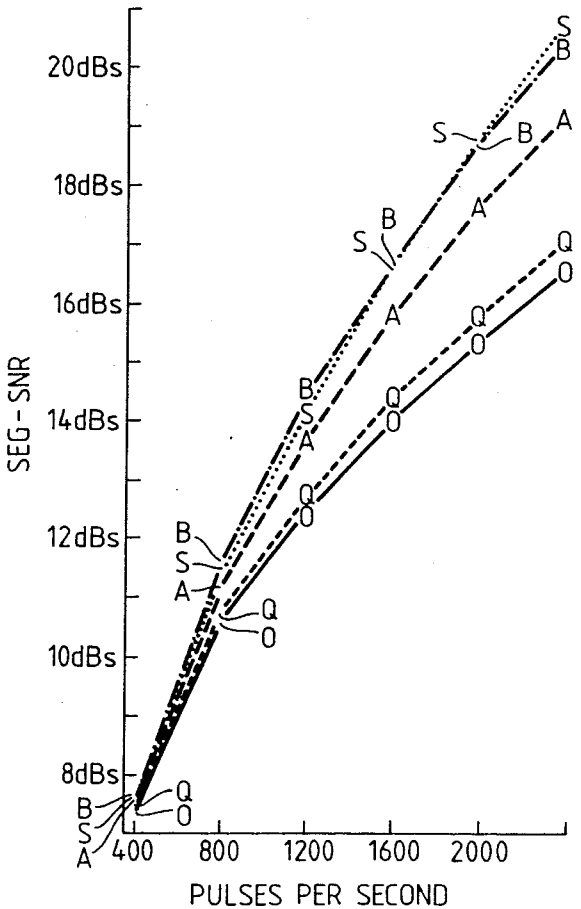
Figure 6:
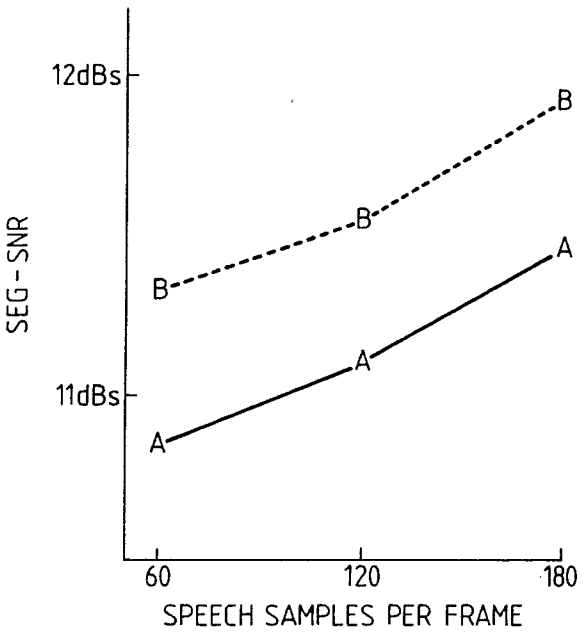

In FIG. 5 the noise shaping constant g was varied. 0.9 appears close to optimum. FIG. 6 shows the variation of SNR with frame size (pulse rate remaining constant) The small increase in SEG-SNR can be attributed to the improved autocorrelation estimates $R_{li}$ obtained when larger analysis frames are used. It is also evident, from FIG. 6, that the proposed algorithms operate satisfactorily with small analysis frames which lead to computationally efficient implementations. FIG. 7 compares the SEG-SNR performance of five multipulse excitation algorithms for a range of pulse rates. Curve 0 gives the performance of the simplified algorithm used to form the Initial Position Estimate for the system A and B, whose performance curves are A and B. Curve Q corresponds to the algorithm used by Atal and Remde, while curve S shows the performance of that algorithm when amplitude optimization is applied every time a new pulse is added to the excitation sequence. Note that the latter two systems employ the autocovariance estimates $B_{li}$ while the first three systems approximate these estimates with the auto correlation values $R_{li}$.

The method proposed here, in essence lifts the pulse location search restrictions found in the methods referred to earlier. The error to be minimized is always calculated for a set of k pulses, in a way similar to the amplitude optimization technique previously encountered, and no assumptions are involved regarding pulse amplitudes or locations. The algorithm commences with an initial estimate of the k-dimensional subspace and continues changing sequentially the subspace, and therefore the pulse positions, in search of the optimum solution. The pulse amplitudes are calculated with a "block" method which projects the input signal $\bar{s}$ onto each subspace under consideration.

The proposed system has the potential to out-perform conventional multipulse excitation systems systems and its performance depends on the search algorithms employed to modify. sequentially the k dimensional subspace under consideration.

A further modification of iterative adjustment process and more especially the criteria for selection of pulses whose positions are to be reassessed will now be considered. The option to be discussed is a modification of scheme (C) referred to above.

The aim is to reduce the computational requirements of the multipulse LPC algorithm described, without reducing the subjective and SNR performance of the system. In scheme C, given the initial excitation estimate, each excitation pulse defines a $\pm\lambda$ region and only the possibility of transferring a pulse to a location within its own region is examined by the algorithm. Thus each of the k initial excitation pulses is tested for transfer into one of $\pm\lambda$ neighbouring locations.

The complexity of the algorithm implementing scheme C is, it is proposed, reduced by testing only $k_1$ pulses for possible transfer where $k_1 < k$. The question then arises of how to select, for possible transfer $k_1$ out of the k initial excitation pulses.

The proposed pulse selection procedure is based on the following two requirements:

(i) the $k_1$ pulses to be tested are associated with a high probability of being transferred to another location within their $\pm\lambda$ region.

(ii) given that an initial excitation pulse is to be transferred to another location, this transfer results in a considerable change in the energy of the synthesized signal in approximating the energy of the input signal.

Recall (equation 14) that the energy of the synthesized signal is $\bar{h}^TD^T\bar{y}$ which is the sum of k energy terms, $h_i\bar{d}_{pi}\bar{y}$ and $D=[\bar{d}_{P1}, \bar{d}_{P2}, \ldots, \bar{d}_{Pk}]$. Each of these terms represents the energy contribution of an excitation pulse towards the total energy of the synthesized signal. Using the (approximate) assumption that the energy contribution of each pulse is independent of the positions/amplitudes of the remaining excitation pulses, one can then relate the above two requirements to a normalized energy measure $E_i$ associated with an excitation pulse i:

$$E_i = \frac{h_i d_{p_i}^T y}{\sum_{j=1}^{k} h_j d_{p_j}^T y} \tag{16}$$

In particular, given that $E_i$ lies within the small energy interval $E^K$, the probability of pulse relocation $\rho(E^K)$ is, $$\rho(E^K) = \frac{m_K}{n_K} \tag{17}$$

where $n_K$ is the number of pulses with energy values within the $E_K$ interval and only $m_K$ of these pulses are actually relocated by the search procedure.

In the second requirement the energy change Q, which results from relocating a pulse from the $p_i$ location to $p_i'$, is given by $$Q = \frac{h_i' d_{p_i'}^T y - h_i d_{p_i}^T y}{\sum_{j-1}^{k} h_j d_{p_j}^T y} \tag{18}$$

An average energy change per transfered pulse is now formed as $$Q_{av}(E^K) = \sum_{j=-\infty}^{\infty} \rho_{Qk,j}\, Q \tag{19}$$

where $$\rho_{QK,j} = \frac{n_{QK,j}}{m_K}$$

$m_K$ is the number of pulses relocated by the search procedure, whose energy value lies within the $E^K$ interval, while $n_{QK,j}$ is the number of those of the $m_K$ pulses whose relocation resulted in an energy change value Q lying within the small energy interval $E^j$.

Using $\rho(E^K)$ and $Q_{av}(E^K)$ an Energy Gain Function $G_e$ is thus defined as $$\begin{aligned} Q_e &= p(E^K)\, Q_{av}(E^K) \\ &= \frac{1}{n_k} \sum_{j=-\infty}^{\infty} n_{Qk,j}\, Q \end{aligned} \tag{20}$$

and represents the average energy change per pulse, which results from the relocated pulses, whose normalized energy E falls within the $E^K$ interval.

Clearly then, the value of the Energy Gain Function $G_e$ should be larger for the $k_1$ pulses, selected to be tested for possible transfer, than for the remaining $k-k_1$ pulses in the initial excitation estimate.

In practice, a plot of Energy Gain Function against normalized Energy E can be obtained—e.g. from several seconds of male and female speech—while a piecewise linear representation is a convenient simplification of this function. The problem of selecting for possible relocation $k_1$ out of k pulses can now be solved using this data. That is, given the initial sequence of excitation pulses, the normalized energy $E_i$ is measured for each pulse and the corresponding $G_e$ values are found from the plot—e.g. as a stored look-up table or computed criteria based on the piecewise linear approximation. Those $k_1$ pulses with the largest $G_e$ values are then selected and tested for relocation.

Figure 8:
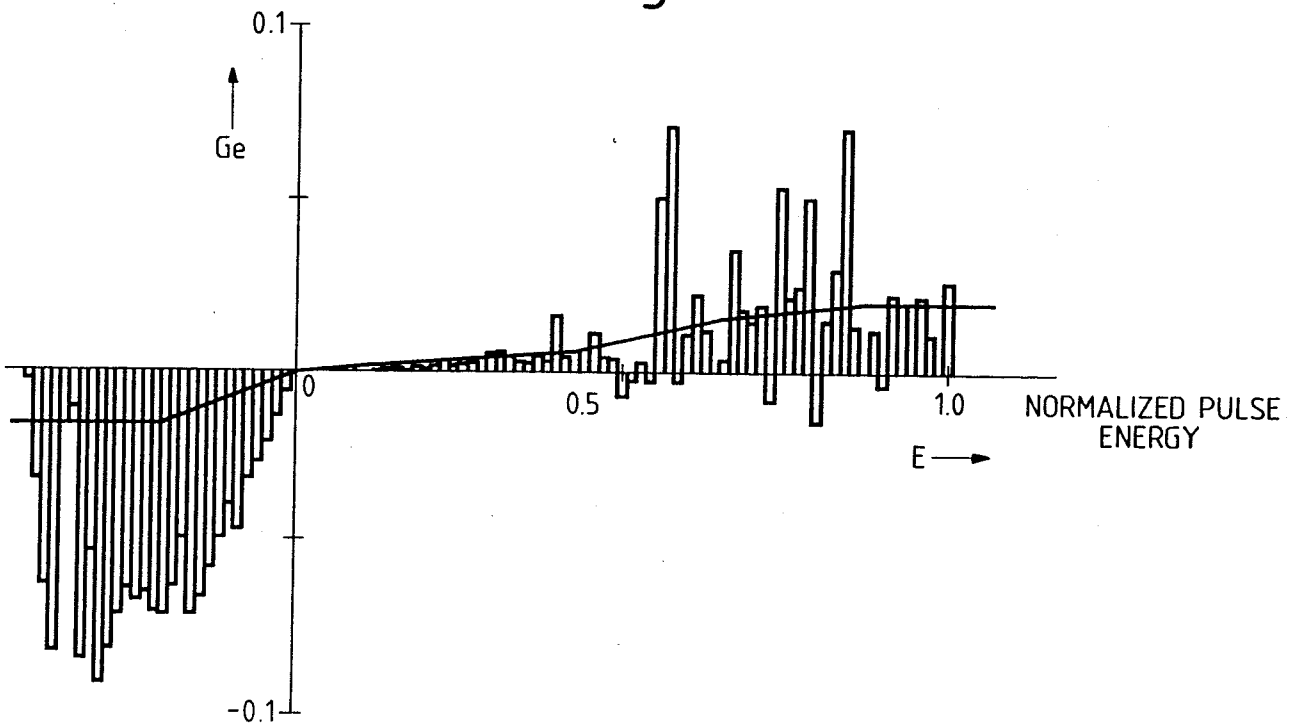
FIG. 8 is a graph of energy gain function against pulse energy.

FIG. 8 shows a typical $G_e$ v. E plot, along with a piecewise linear approximation. It will be noted that if, as shown, the curve is monotonic (which is not always the case) then the largest $G_e$ always corresponds to the largest E. In this instance the conversion is unnecessary: the method reduces to selecting only those $k_1$ pulses with the largest values of E. In some circumstances it may be appropriate to use E' instead of E as the horizontal axis for the plot, and indeed this is in fact so for FIG. 8. (E' is given by equation 16 with h' and d' substituted for h and d).

Figure 9:
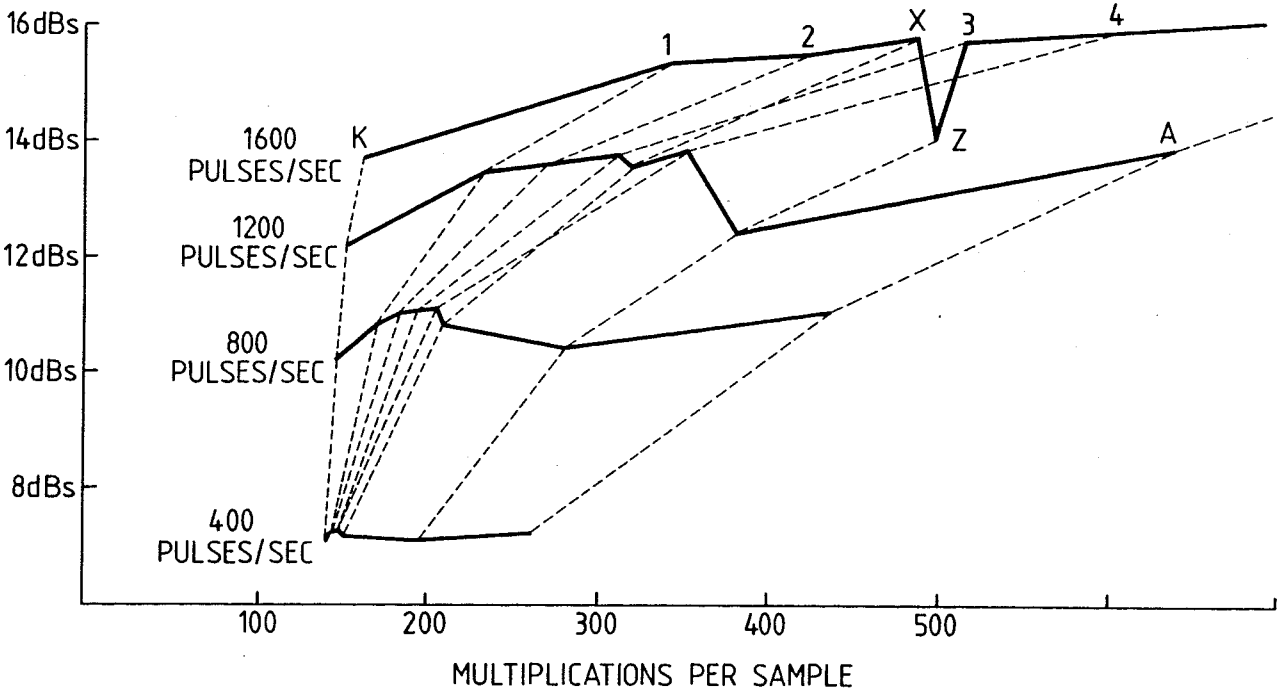
FIGS. 9 to 11 are graphs illustrating results obtained using the function illustrated in FIG. 8.

FIG. 9 shows the signal-to-noise ratio performance against multiplications required per input sample, for the following four multistage sequential search algorithms:

A: ATAL's scheme with amplitude optimization at each stage

Z: ATAL's scheme without amplitude optimization at each stage

X: INITIAL ESTIMATE algorithm with amplitude optimization at each stage.

K: INITIAL ESTIMATE algorithm without amplitude optimization at each stage.

as well as for the proposed block sequential algorithm using the simplified scheme C of pulse selection and destination when allowing 1/6, 2/6, 3/6 and 4/6 of the initial pulses to be tested for transfer.

The graph shows average segmental SNR obtained at a constant pulse rate with different multipulse algorithms (solid line), for a particular speech sentence The horizontal axis indicates the algorithm complexity in number of multiplications per sample. The intermittent line shows the SNR performance of each algorithm when its complexity is varied by changing the pulse rate.

Note that the complexity of the proposed algorithm is considerably reduced for small transfer pulse ratios while the SNR performance is almost unaffected.

Figure 10:
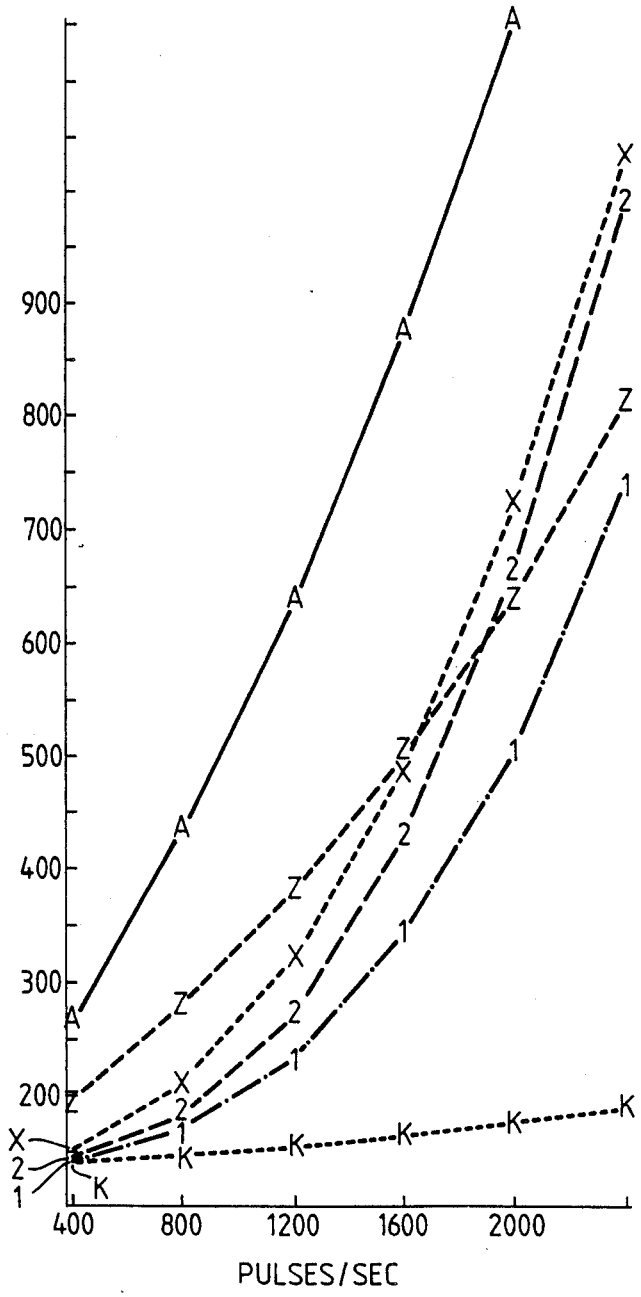

FIG. 10 shows for the above system, the number of multiplications required per input sample versus excitation pulses per second.

Figure 11:
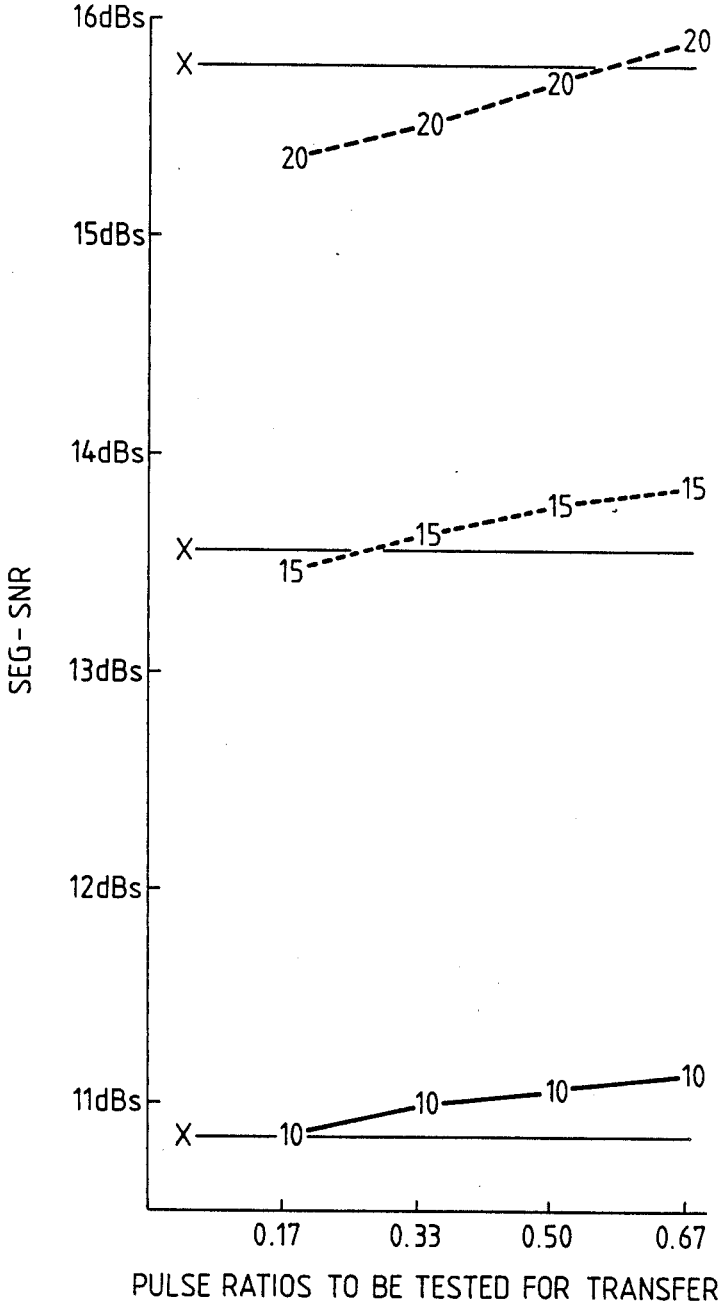

FIG. 11 illustrates the SNR performance of the proposed system for different values of pulse ratios to be tested for transfer. Results are shown for 800 pulses/sec (10 percent, 1200 pulses/sec (15 percent) and 1600 pulses/sec (20 percent). Note that the solid line in FIG. 11 corresponds to performance of the Initial Estimate algorithm with amplitude optimization at each stage of the search process.

We claim:

1. A method of speech coding comprising:

receiving speech samples;

processing the speech samples to derive parameters representing a response of a synthesis filter;

deriving, from the parameters and the speech samples, pulse position and amplitude information defining an excitation consisting, within each of successive time frames corresponding to a plurality n of said speech samples, of a pulse sequence containing a smaller plurality k of pulses;

wherein the pulse position and amplitude information of the k pulses is derived by:

(1) deriving an initial estimate of the positions and amplitudes of the k pulses, and (2) carrying out an iterative adjustment process by:

(a) selecting individual ones of the k pulses according to predetermined criteria, and (b) substituting for each such selected pulse a pulse in an alternative position whenever a computed error signal is thereby reduced, said error signal being obtained by comparing speech samples with the response of a filter having said parameters to an excitation which includes said selected pulse and others of said pulses, said substituted alternative position thereby being obtained as a function of the position and amplitudes of said other pulses.

2. A method according to claim 1 in which said initial estimate of the pulse positions is made by cross-correlating a set of n input speech sample amplitudes occurring during each frame with each of a set of normalized vectors corresponding to time-shifted impulse responses of the filter and selecting the relative positions of the k largest values of such cross-correlation as the k pulse positions used in said initial estimate.

3. A method according to claim 1 in which said initial estimate of the k pulse positions is made by cross-correlating a set of n input speech sample amplitudes during each frame and each of a set of normalized vectors corresponding to time-shifted impulse responses of the filter and selecting the relative position of the largest value of such cross-correlation as the first pulse position in said initial estimate; with successive $k-1$ pulse positions corresponding to the position of a largest value of adjusted further cross-correlations between an input speech vector and the said normalized vectors, the further cross-correlations for each successive pulse position selection having been adjusted by subtraction of values representing orthogonal projections of vector representations of earlier selected pulses onto axes represented by corresponding normalized vectors.

4. A method according to claim 1, 2 or 3 in which the iterative adjustment process is effected by repeated selection of one of the pulses according to a predetermined criterion, and substituting for that pulse a pulse in an alternative position only if such substitution results in a reduction in the said error, the pulse amplitudes being again derived following each such substitution.

5. A method according to claim 4 in which the predetermined criterion for pulse selection is effected by deriving k energy terms, each of which is the product of a pulse amplitude and the corresponding term of the vector formed by multiplying a convolution matrix of the filter and the difference between said input speech vector and a filter response from previous frames, each being adjusted by any perceptual weighting factor.

6. A method according to claim 4 in which the alternative positions are selected successively in sequence from n available positions, such that no alternative position is tested for substitution more than once.

7. A method according to claim 6 in which zones are defined as including a predetermined number of potential alternative positions adjacent a position already occupied by a pulse, and different criteria for selection of a pulse to be substituted are employed dependent on whether a selected alternative position is within or outside the said zones.

8. A method according to claim 7 in which whenever the selected alternative position falls within a zone, no pulse is selected for substitution.

9. A method according to claim 7 in which whenever a next available alternative position in sequence is within one of the zones a pulse defining that zone is selected for possible substitution.

10. A method according to claim 6 in which only certain pulses are selected for possible substitution, those pulses being those whose normalized energy has a larger energy gain function than the unselected pulses, the energy gain function for pulses having energies lying within a given energy interval being an average energy change resulting from relocation of a pulse having an energy within that interval.

11. A method according to claim 11 in which the energy gain function for each pulse is obtained from a lookup table having entries for energy intervals and corresponding energy gain functions, the lookup table having been empirically derived from a training sequence of speech.

12. A method according to claim 1, 2 or 3 in which the pulse amplitudes, in the initial estimate step or during the iterative adjustment process, are calculated using the relation $$\bar{h}=(D^TD)^{-1}D^T\bar{y}$$

where $\bar{h}$ is a vector consisting of k amplitudes, D is a set of time shifted filter impulse responses corresponding to the pulse positions, and $\bar{y}$ is a difference between the input speech vector and the filter response from previous frames; D and $\bar{y}$ being adjusted by a perceptual weighting.

13. An apparatus for speech coding comprising:
means for receiving speech samples;
means for processing the speech samples to derive parameters representing a response of a synthesis filter;
means for deriving, from the parameters and the speech samples, pulse position and amplitude information defining an excitation consisting, within each of successive time frames corresponding to a plurality n of said speech samples, of a pulse sequence containing a smaller plurality k of pulses;
wherein the means for deriving pulse position and amplitude information of the k pulses includes:
(1) further means for deriving an initial estimate of the positions and amplitudes of the k pulses, and
(2) means for carrying out an iterative adjustment process by:
(a) selecting individual ones of the k pulses according to predetermined criteria, and
(b) substituting for each such selected pulse a pulse in an alternative position whenever a computed error signal is thereby reduced, said error signal being obtained by means for comparing speech samples with the response of a filter having said parameters to an excitation which includes said selected pulse and others of said pulses, said substituted alternative position thereby being obtained as a function of the position and amplitudes of said other pulses.

14. An apparatus according to claim 13 in which said initial estimate of the pulse positions is made by means for cross-correlating a set of n input speech sample amplitudes occurring during each frame with each of a set of normalized vectors corresponding to time-shifted impulse responses of the filter and means for selecting the relative positions of the k largest values of such cross-correlation as the k pulse positions used in said initial estimate.

15. An apparatus according to claim 13 in which said initial estimate of the k pulse positions is made by means for cross-correlating a set of n input speech sample amplitudes during the frame and each of a set of normalized vectors corresponding to time-shifted impulse responses of the filter and means for selecting the relative position of the largest value of such cross-correlation as the first pulse position in said initial estimate; with successive k−1 pulse positions corresponding to the position of a largest value of adjusted further cross-correlations between an input speech vector and the said normalized vectors, the further cross-correlations for each successive pulse position selection having been adjusted by means for subtracting values representing orthogonal projections of vector representations of earlier selected pulses onto axes represented by corresponding normalized vectors.

16. Apparatus according to claim 13, 14 or 15 in which the iterative adjustment process is effected by repeated selection of one of the k pulses according to a predetermined criterion, and further including means for substituting for said selected pulse a pulse in an alternative position only if such substitution results in a reduction in the said error signal, the pulse amplitudes being again derived following each such substitution.

17. Apparatus according to claim 16 in which the predetermined criterion for pulse selection is effected by deriving k energy terms, each of which is the product of a pulse amplitude and the corresponding term of the vector formed by means for multiplying a convolution matrix of the filter and the difference between said input speech vector and a filter response from previous frames, each being adjusted by any perceptual weighting factor.

18. Apparatus according to claim 16 in which the alternative positions are selected successively in sequence from the available positions, such that no alternative position is tested for substitution more than once.

* * * * *